United States Patent [19]

Pantus

[11] Patent Number: 5,017,906

[45] Date of Patent: May 21, 1991

[54] APPARATUS AND METHOD FOR COMBINING ANALOG DETECTION SIGNALS TO PROVIDE ENHANCED ALARM INTEGRITY

[75] Inventor: Math M. J. Pantus, Brunssum, Netherlands

[73] Assignee: Aritech Corporation, Framingham, Mass.

[21] Appl. No.: 418,130

[22] Filed: Oct. 6, 1989

[51] Int. Cl.[5] ..... G08B 23/00

[52] U.S. Cl. ..... 340/517; 340/506; 340/522; 340/511

[58] Field of Search ..... 340/517, 522, 506, 511, 340/661, 660, 870.01, 870.21, 537; 341/132, 126, 151, 158

[56] References Cited

U.S. PATENT DOCUMENTS

| | | | |
|---|---|---|---|
| 3,846,790 | 11/1974 | Erdmann et al. | 340/522 |
| 4,001,649 | 1/1977 | Young | 340/522 |
| 4,075,697 | 2/1978 | Ochiai et al. | 340/522 |
| 4,368,460 | 1/1983 | Clinard et al. | 340/522 |
| 4,459,583 | 7/1984 | van der Watt et al. | 340/661 |
| 4,626,831 | 12/1986 | Engel | 340/511 |
| 4,660,024 | 4/1987 | McMaster | 340/522 |
| 4,765,244 | 8/1988 | Spector et al. | 340/522 |

*Primary Examiner*—Donnie L. Crosland

*Attorney, Agent, or Firm*—Weingarten, Schurgin, Gagnebin & Hayes

[57] ABSTRACT

An apparatus and method for combining detection signals generated by intrusion detection systems to provide improved alarm integrity therefor. The apparatus and method have utility with mixed sensor technology and single sensor technology detection systems. In one embodiment, analog detection signals generated by system sensors are combined in an analog multiplier and the resulting decision signal is compared via a unipolar threshold comparator or a window comparator. In another embodiment, analog detection signals are amplitude limited prior to being combined in the analog multiplier. In a further embodiment, analog detection signals are subjected to average value processing such that the decision signal has a value equal to one-half of the sum of the sensor signals. In yet a further embodiment, analog dectection signals are amplitude limited prior to average value processing.

9 Claims, 6 Drawing Sheets

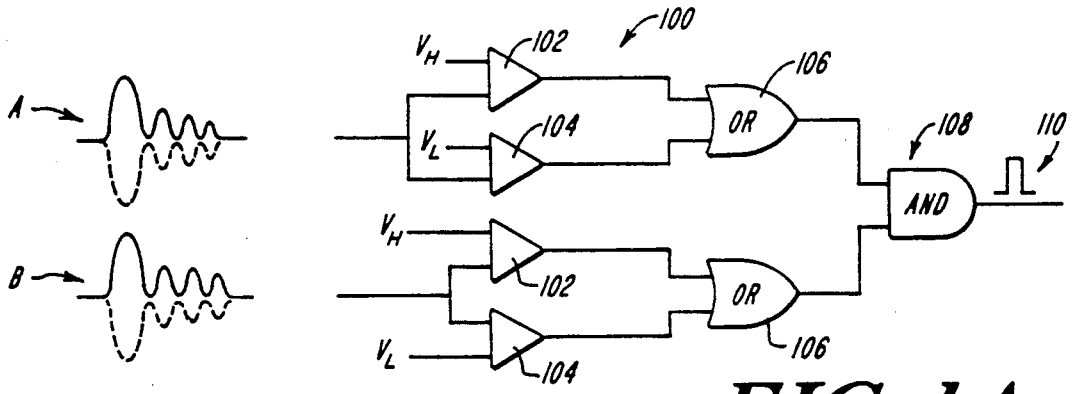
FIG. 1A
(PRIOR ART)
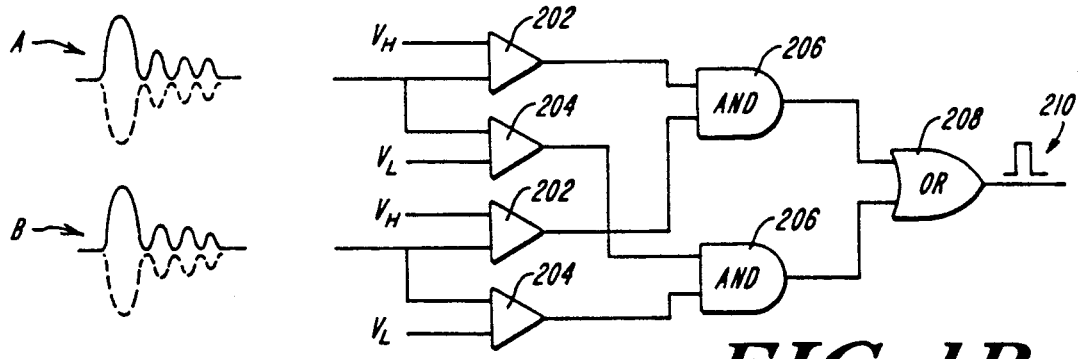
FIG. 1B
(PRIOR ART)
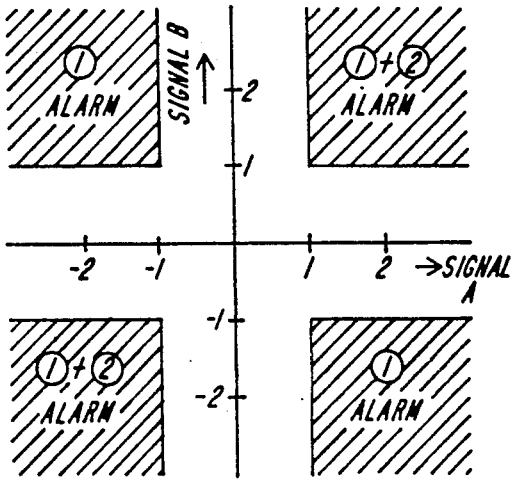
FIG. 1D
(PRIOR ART)
| A | B | Ac | Bc | ALARM 110 |
|---|---|---|---|---|
| 0 | 0 | 0 | 0 | 0 |
| 1 | 0 | 1 | 0 | 0 |
| 0 | 1 | 0 | 1 | 0 |
| 1 | 1 | 1 | 1 | 1 |
| 2 | 2 | 1 | 1 | 1 |
| 2 | .5 | 1 | 0 | 0 |
| 1.3 | .8 | 1 | 0 | 0 |
FIG. 1C
(PRIOR ART)

FIG. 2A
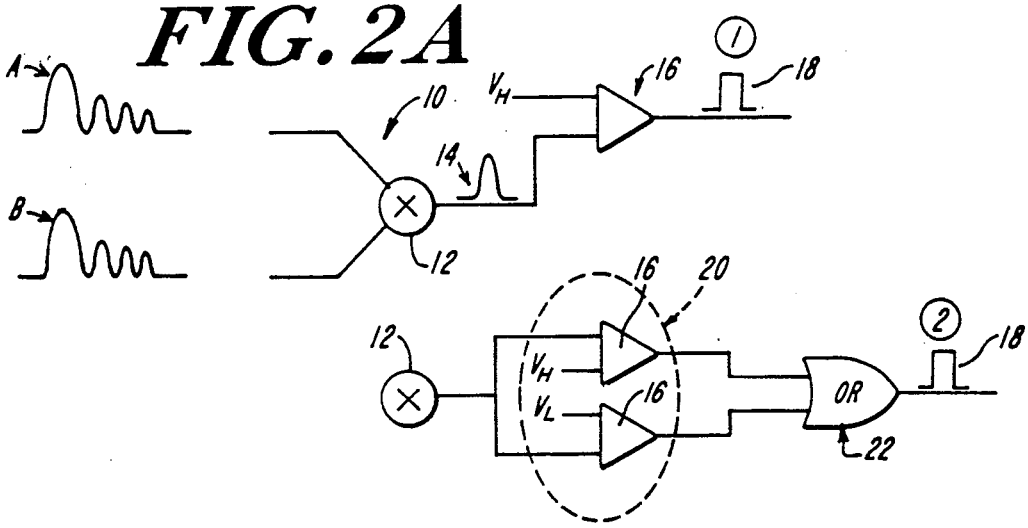
FIG. 2A'
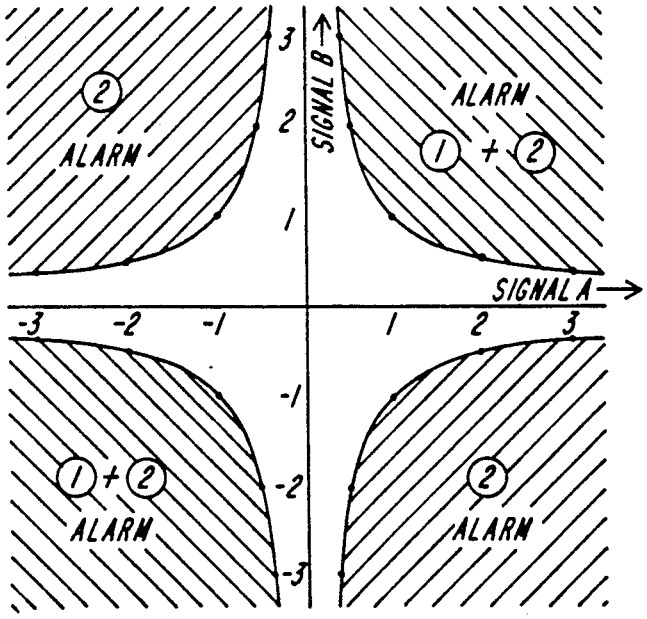
FIG. 2C
| A | B | A x B | ALARM 1 | ALARM 2 |
|---|---|---|---|---|
| 0 | 0 | 0 | 0 | 0 |
| 1 | 1 | 1 | 1 | 1 |
| 3 | .4 | 1.2 | 1 | 1 |
| 0.5 | 2 | 1.0 | 1 | 1 |
| 0.5 | 1.5 | .75 | 0 | 0 |
| -2 | 1 | -2 | 0 | 1 |
| 1.3 | .8 | 1.04 | 1 | 1 |
FIG. 2B

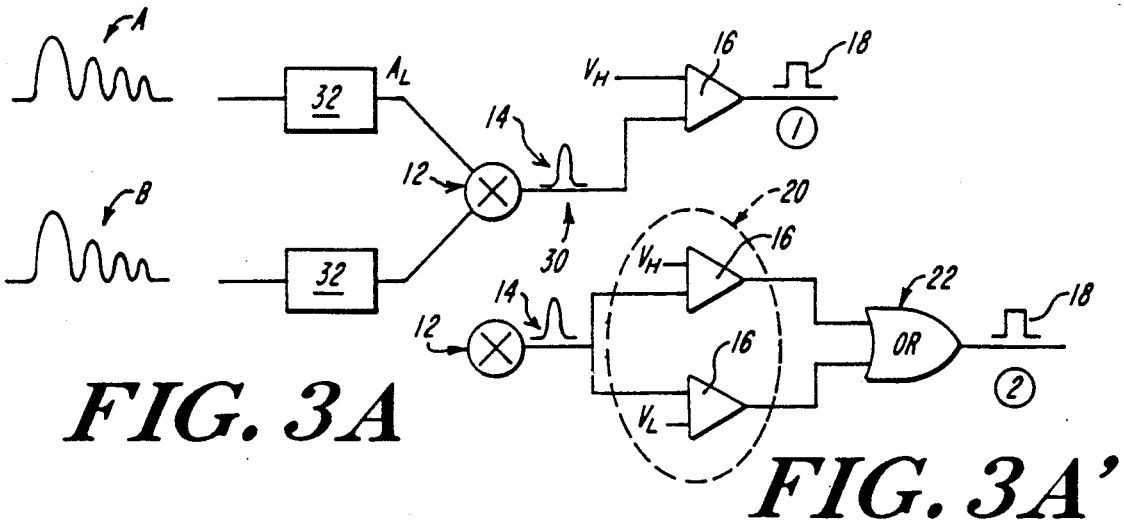
FIG. 3A
FIG. 3A'
| A | B | $A_L$ | $B_L$ | $A_L \times B_L$ | ALARM 1 | ALARM 2 |
|---|---|---|---|---|---|---|
| 0 | 0 | 0 | 0 | 0 | 0 | 0 |
| 1 | 1 | 1 | 1 | 1 | 1 | 1 |
| 3 | .5 | 2 | .5 | 1 | 1 | 1 |
| 3 | .4 | 2 | .4 | .8 | 0 | 0 |
| 10 | .1 | 2 | .1 | .2 | 0 | 0 |
| -4 | 3 | -2 | +2 | -4 | 0 | 1 |
FIG. 3B
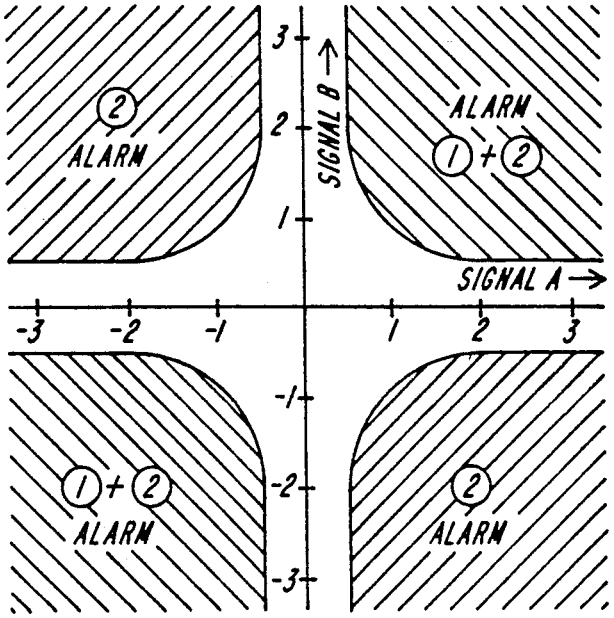
FIG. 3C

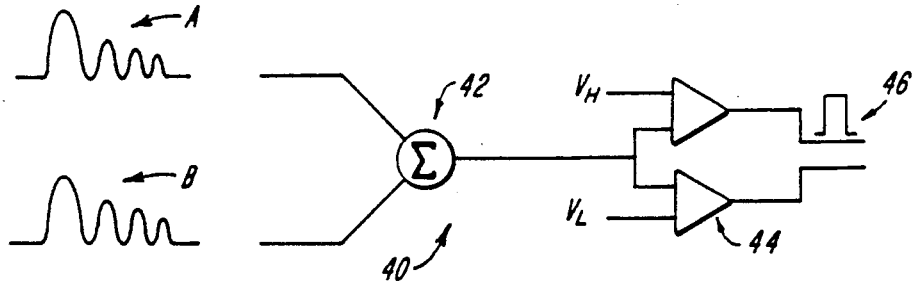
FIG. 4A
FIG. 4A'
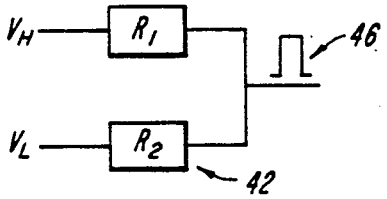
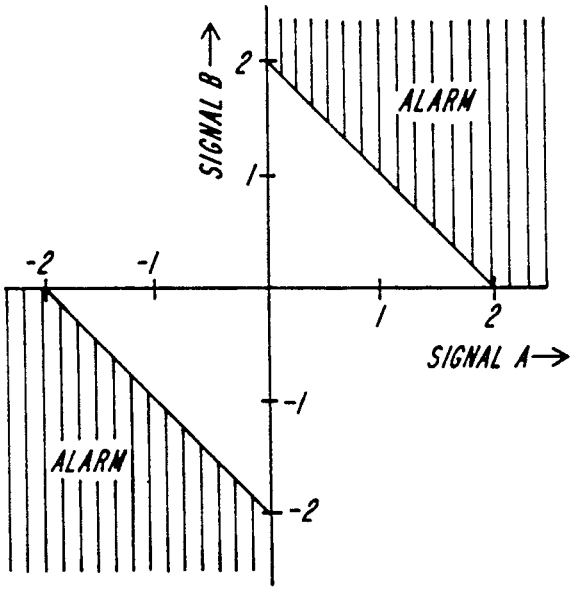
FIG. 4C
| A | B | (A+B) / 2 | ALARM(46) |
|---|---|---|---|
| 0 | 0 | 0 | 0 |
| 1 | 1 | 1 | 1 |
| 0.5 | 2 | 1.25 | 1 |
| 0 | 2 | 1 | 1 |
| 2 | 0 | 1 | 1 |
| 1.25 | .75 | 1 | 1 |
| 1.5 | 0.5 | 1 | 1 |
| 0.5 | 1.0 | .75 | 0 |
FIG. 4B

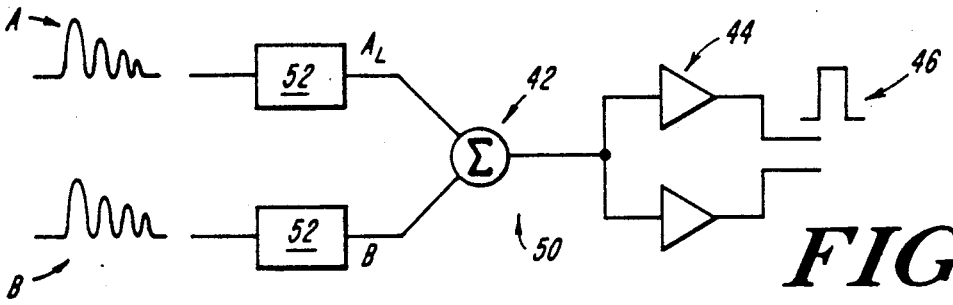
FIG. 5A
| A | B | $A_L$ | $B_L$ | $\frac{(A_L+B_L)}{2}$ | ALARM(46) |
|---|---|---|---|---|---|
| 0 | 0 | 0 | 0 | 0 | 0 |
| 3 | .5 | 1.5 | 0.5 | 1 | 1 |
| 10 | .4 | 1.5 | 0.4 | 0.75 | 0 |
FIG. 5B
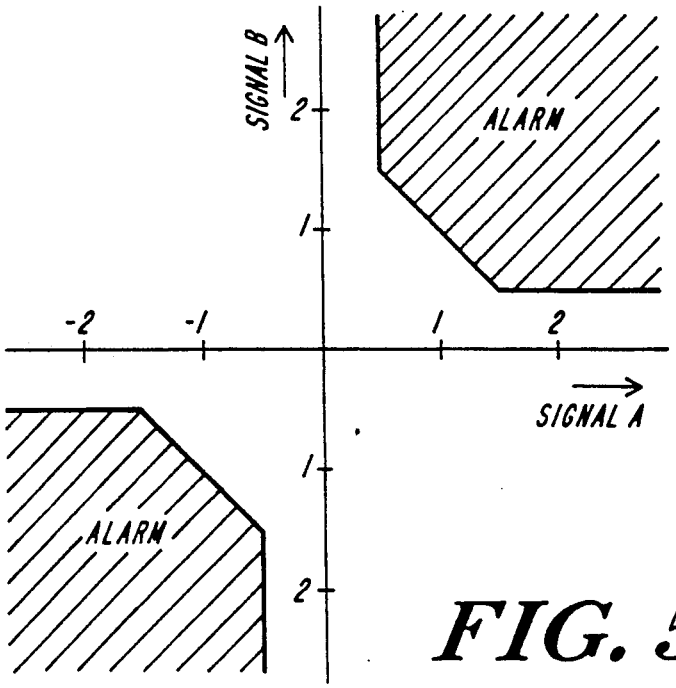
FIG. 5C

APPARATUS AND METHOD FOR COMBINING ANALOG DETECTION SIGNALS TO PROVIDE ENHANCED ALARM INTEGRITY

FIELD OF THE INVENTION

The present invention relates generally to intrusion detection systems, and more particularly to apparatus and method for combining analog detection signals generated by intrusion detection systems to improve the alarm integrity thereof.

BACKGROUND OF THE INVENTION

Basic intrusion detection systems that utilize active or passive detectors such as passive infrared sensors (PIR), microwave sensors, and ultrasonic sensors to detect the presence of an intruder in a protected zone are well known in the art. Radiation received from the protected zone is electronically processed and an alarm signal generated by the system when the received radiation exceeds a predetermined threshold. The utility of basic intrusion detection systems is limited by susceptibility to spurious alarms/alarm failure due to various Phenomena such as noise, variations in atmospheric conditions, random thermal activity, changes in placement/operability of protected zone equipment, and changes in actual versus design range of the system.

Combining detection signals is one means of improving alarm integrity, i.e., reducing spurious alarms. Dual element balanced detectors, as disclosed in U.S. Pat. Nos. 4,707,604, 4,514,631, 4,364,030, 4,343,987, and 3,839,640, provide common mode rejection of detection signals caused by randomly varying thermal activity. Balanced detectors utilize dual PIR sensors that are electrically connected in series opposition to produce opposite polarity signals. The combined signals from randomly varying thermal activity are self-cancelling over time.

Another means of reducing spurious alarms by combining detection signals is seen in verified intrusion detection systems wherein two separate detection signals are generated and subsequently combined to provide an alarm decision signal having a higher integrity. Signal verification may be used in single sensor technology systems such as PIR/PIR detection systems or in mixed sensor technology systems such as PIR/microwave and PIR/ultrasonic detection systems.

FIGS. 1A, 1B illustrate prior art verification systems for combining two independent analog detection signals to generate a decision signal having higher integrity. Signals A and B are analog signals typically generated by PIR, microwave, and/or ultrasonic sensors and processing subsystems. In general, analog detection signals exhibit an increase in amplitude when an intruder is present within the protected zone. When both analog detection signals A, B are greater than a unity threshold magnitude, the decision signal causes an alarm to be triggered, i.e., AND verification. Discussed hereinbelow are two known methods to accomplish AND verification.

FIG. 1A illustrates one exemplary AND verification subsystem 100 for processing analog detection signals A, B generated by sensor and electronic processing subsystems (not shown) of an intrusion detection system. Each analog detection signal A, B is fed to a pair of comparators 102, 104 for comparison to predetermined detection thresholds, $V_H$, $V_L$, respectively. Each pair of comparators 102, 104 is coupled to an OR gate 106 such that a detection signal exceeding the detection threshold causes the corresponding OR gate 106 to generate an output signal. The OR gates 106 are coupled to an AND gate 108 that generates a decision signal 110 to trigger an alarm. Both OR gates 106 must generate an output signal before the AND gate 108 will generate the decision signal 110.

Another exemplary embodiment of an AND verification subsystem 200 is illustrated in FIG. 1B, and includes pairs of comparators 202, 204 biased for predetermined detection thresholds $V_H$, $V_L$, two AND gates 206, and one OR gate 208. In this embodiment the outputs of the high threshold comparators 202, 202 and the low threshold comparators 204, 204 are coupled to corresponding AND gates 206 as illustrated. When both analog detection signals A, B simultaneously exceed a predetermined threshold, either $V_{high}$ or $V_{low}$, the corresponding AND gate generates an output signal. An output signal from either AND gate 206 causes the OR gate 208 to generate a decision signal 210 that triggers an alarm.

One limitation of these types of systems is that both input analog detection signals must be over a predetermined unity threshold at the same time. This operating condition usually results in decreased system sensitivity, or even no detection at all. There are several reasons for such decreased sensitivity.

In PIR/PIR verified detection systems the upper sensing elements are referenced at the upper parts of the human body which generally transmits significantly more infrared radiation than the lower parts of the body. This occurs since the head and hands are relatively hot and unclothed while the lower body portions are usually clothed and as a result generate less infrared radiation contrast. To compensate for these differences in target contrast, the detection system normally requires enhanced sensitivity which may be achieved by increasing the gain of the amplifiers or by reducing the detection threshold levels. Furthermore, such detection systems generally have mounting constraints as the A and B sensor elements will receive less energy if the mounting height is not optimum for the target.

In PIR/microwave and PIR/ultrasonic detection systems the preferred direction for the optimal detection zone is under 45 degrees as referenced to the detector. For operation in this detection zone, both sensing technologies generate comparable signal levels. In addition, for these detection systems it may be necessary to increase the sensitivity of both sensor subsystems to avoid stringent walk directional limitations.

SUMMARY OF THE INVENTION

The inherent limitations and disadvantages of prior art AND verification circuits are overcome by means of the present invention which provides apparatus and methods for combining analog detection signals generated by single sensor technology and mixed sensor technology intrusion detection systems for enhanced alarm integrity. The apparatus and method according to the present invention provides increased sensitivity for intrusion detection systems.

In one embodiment according to the present invention, discrete analog detection signals are combined by means of an analog multiplier to generate an alarm decision signal. The alarm decision signal may be coupled to a unipolar threshold comparator (positive detection signals) or a window comparator (positive and negative detection signals) for comparison with predetermined threshold(s). If the alarm decision signal exceed the comparator threshold, an output signal is generated to trigger a system alarm.

In a modified embodiment of the above-described apparatus signal limiters are inserted into the analog detection signal pathways prior to the analog multiplier to limit the amplitudes of the analog detection signals to predetermined limits that depend on such factors as system noise level and sensor technologies utilized to generate the analog detection signals. This embodiment reduces the probability of spurious alarms due to phenomena such as static discharges, radio frequency interference, wall vibrations and/or shocks or technical error signals in one of the detector subsystems.

In another embodiment according to the present invention, discrete analog detection signals are processed by means of a summing network which comprises an average value processing circuit which may comprise a resistive summing network. The analog detection signals flow through resistors of equal value to provide an alarm decision signal that has a value equal to one half of the sum of the amplitudes of the analog detection signals. The alarm decision signal is coupled to a window comparator that generates an output signal to activate the system alarm whenever the predetermined threshold of the comparator is exceeded.

In another embodiment based upon the average value apparatus as described in the paragraph above, signal limiters are inserted in the average value processing circuit to limit the amplitudes of the analog detection signals to predetermined limit values. In one preferred embodiment, a limiting resistive network is coupled to operational amplifiers forming the preprocessing electronics that produce the analog detection signals. The limiting resistive network limits the amplitude swing of the operational amplifiers to provide limited analog detection signals at the output thereof.

BRIEF DESCRIPTION OF THE DRAWINGS

A more complete understanding of the present invention and the attendant advantages and features thereof will be more readily understood by reference to the following detailed description when considered in conjunction with the accompanying drawings wherein:

FIGS. 1A–1B illustrate prior art AND detection processing subsystems for combining two analog detection signals to generate a decision signal having a higher integrity;

FIGS. 1C–1D depict the truth table and decision signal curves for the AND detection processing subsystems of FIGS. 1A, 1B;

FIG. 2A and 2A' depict one embodiment of an apparatus and method according to the present invention for combining two analog detection signals to generate a decision signal having a higher integrity;

FIGS. 2B–2C illustrate the truth table and decision signal curves for the signal processing subsystem of FIG. 2A;

FIG. 3A and 3A' show another embodiment of an apparatus and method according to the present invention for combining two analog detection signals to generate a decision signal having a higher integrity;

FIGS. 3B–3C depict the truth table and decision signal curves for the signal processing subsystem of FIG. 3A;

FIG. 4A and 4A' illustrates yet another embodiment of an apparatus and method according to the present invention for combining two analog detection signals to generate a decision signal having a higher integrity;

FIGS. 4B–4C shows the truth table and decision signal curves for the signal processing subsystem of FIG. 4A;

FIG. 5A depicts still another embodiment of an apparatus and method according to the present invention for combining two analog detection signals to generate a decision signal having a higher integrity;

FIGS. 5B–5C depict the truth table and decision signal curves for the signal processing subsystem of FIG. 5A.

DETAILED DESCRIPTION OF PREFERRED EMBODIMENTS

Figure 6:
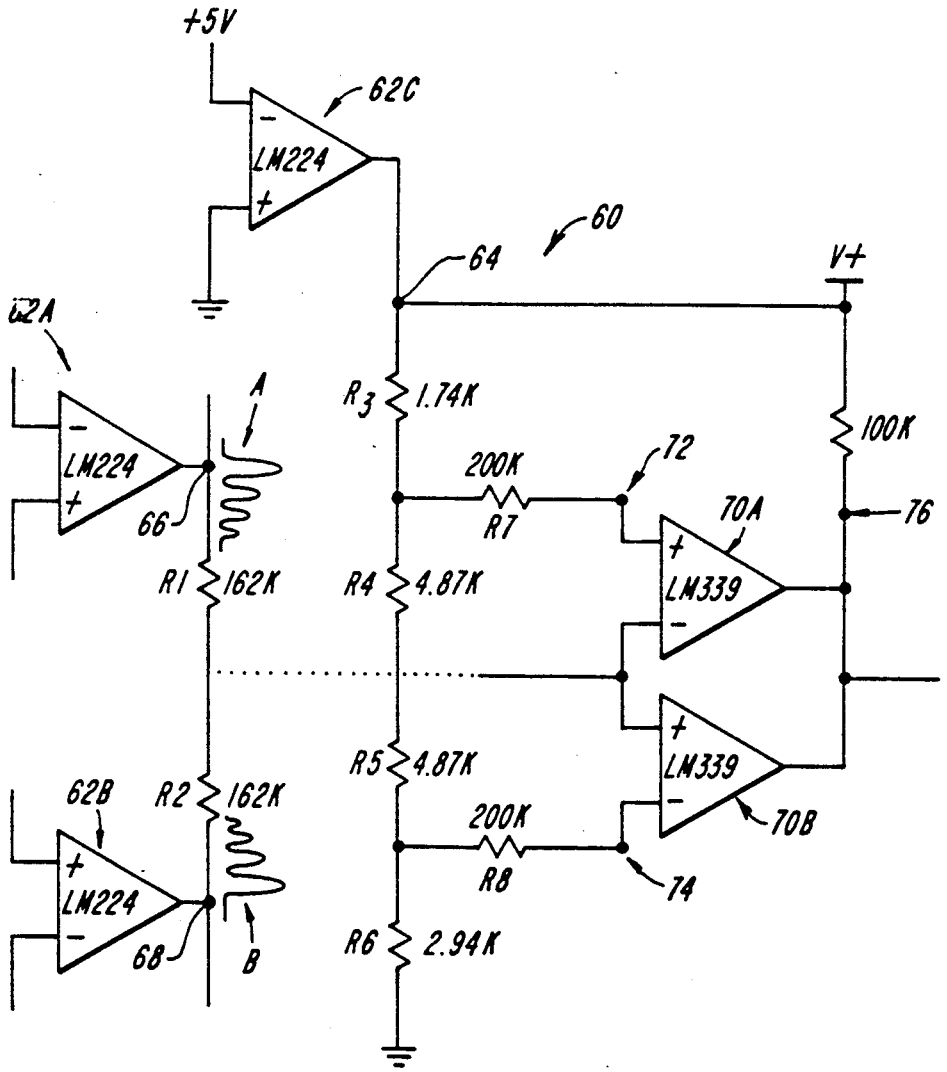
FIG. 6 illustrates one preferred embodiment of a limited summing circuit for use with the apparatus of FIG. 5A.

Referring now to the drawings wherein like reference numerals designate corresponding or similar elements throughout the several views, FIGS. 2–5 illustrate several apparatus and methods for more efficiently combining two analog detection signals A, B to generate a decision signal having a higher integrity than prior art systems. It is to be understood that the apparatus and methods as described hereinbelow may be used with single sensor technology such as PIR/PIR detectors or mixed sensor technology such as PIR/microwave or PIR/ultrasonic detectors.

The PIR, microwave, and/or ultrasonic sensors utilized in combination with the present invention are types known in the art. Likewise, the preprocessing electronics such as amplifiers and/or filters used to generate the analog detection signals A, B from radiation received from the protected zone are known in the art. To simplify the explanation of the present invention, the sensor subsystems and the preprocessing electronics that generate the analog detection signals have been omitted from the drawings.

An embodiment of an apparatus 10 according to the present invention is exemplarily illustrated in FIG. 2A. Discrete analog detection signals A, B generated by the initial stages of the detection system are combined in an analog multiplier 12 to generate a decision signal 14. The decision signal 14 may be fed to a comparator 16 biased by a predetermined unipolar threshold $V_H$ for positive results only. If the decision signal 14 exceeds the predetermined unipolar threshold, an output signal 18 is generated to trigger the system alarm.

Alternatively, FIG. 2A' shows that the decision signal may be fed to a window comparator 20 comprising a pair of comparators 16, 16 biased by predetermined high and low threshold voltages, $V_H$, $V_L$, respectively. The comparators 16, 16 are coupled to an OR gate 22 that generates an output signal 18 to trigger the system alarm if either $V_H$ or $V_L$ is exceeded by the decision signal 14. This alternative permits either positive or negative decision signals 14 to be used to trigger the alarm.

For this embodiment, one strong analog detection signal, e.g., analog detection signal A equals 1.3, may be combined with a somewhat weaker analog detection signal, e.g., analog detection signal B equals 0.8, by means of the analog multiplier 12 to produce a decision signal 14 having a magnitude of 1.03 (see FIG. 2B). This decision signal 14 is greater than the threshold level of the unipolar threshold comparator 16 such that the output signal 18 is generated to trigger the system alarm. Contrast this with the truth table of FIG. 1C wherein analog detection signals A, B having magnitudes of 1.3 and 0.8, respectively, are insufficient to trigger an alarm.

Because of "dynamic" adjustments to the target detection signals provided by the analog multiplier, the above-described embodiment according to the present invention provides for satisfactory intrusion detection system operation with variations in detector mounting heights, target contrast differences (PIR/PIR verified detectors) and/or walk motion detection (PIR/microwave or PIR/ultrasonic verified detectors). In the embodiment of FIG. 2A and 2A', it will be noted that there is no limit to the dynamic features of the analog multiplier. With reference to FIG. 2C, one analog detection signal may momentarily reach a very high signal level, e.g., analog detection signal A equals 10, while the noise level of the other analog detection signal is simultaneously at a sufficiently high level, e.g., analog detection signal B equals 0.1, such that the combined decision signal 14 from the analog multiplier 12 has a value of 1.0, which is sufficient to generate the output signal 18 to trigger the system alarm. Thus, spurious alarms may occur due to unwanted phenomena such as static discharges, radio frequency interference, wall vibrations and shocks, or technical error signals in one of the detector subsystems.

FIG. 3A and 3A' illustrate a modified embodiment 30 of the apparatus 10 of FIG. 2A and 2A' wherein the dynamic features of the analog multiplier 12 are effectively circumscribed. Signal limiters 32 are inserted in the analog detection signal pathways prior to the analog multiplier 12 to limit the values (amplitudes) of the analog detection signals A, B transmitted to the analog multiplier 12 to a predetermined upper and/or lower limit value X, which for purposes of the following discussion of the conceptual functionality of the apparatus 30 circuit is shown as a limit value of 2. The other elements of the apparatus 30 and the functioning thereof are as described hereinabove for the embodiment of FIG. 2A.

With reference to FIG. 3B, a very high level analog detection signal, e.g., analog detection signal A equals 10, will be processed by signal limiter 32 such that the limited detection signal $A_L$ has a value of 2. If analog detection signal B simultaneously has a noise level equal to 0.1, i.e., a limited detection signal $B_L$ value of 0.1, the combined decision signal 14 from the analog multiplier 12 has a value of only 0.2, which is insufficient to generate an output signal 18 to trigger the system alarm. It will be appreciated that the exact magnitude of the limit values for the signal limiters depends upon system noise levels and technologies utilized to generate analog detection signals A, B.

The analog multiplier used in the above-described circuits is a relatively complex and expensive component. Standard designs for analog multipliers require either selected transistors in combination with special thermistors to compensate for temperature drift or integrated operational transconductancy amplifiers or self-contained integrated multipliers.

Yet another embodiment of an apparatus 40 according to the present invention is illustrated in FIG. 4A and 4A'. The apparatus 40 of this embodiment has decision signal curves, see FIG. 4B, that are linear approximations to the decision signal curves of the above-described embodiment (see FIG. 3B). The apparatus 40 includes a summing network 42 and a comparator 44. The summing network 42 may be configured to provide average value processing of the analog detection signals A, B by inputting the voltages of the analog detection signals A, B to a resistor network 42, comprising two resistors R of equal value as illustrated in FIG. 4A'. The decision signal 46 outputted by the resistor network 42 will have a magnitude equal to (A+B)/2 (see FIG. 4B).

A modified embodiment 50 of the apparatus 40 of FIG. 4A is illustrated in FIG. 5A wherein signal limiters 52 are inserted in the analog detection signal pathways to limit the values of the analog detection signals A, B transmitted to the summing circuit 42 to a predetermined limit value Y. Selecting the signal limiters 52 to provide limited analog detection signals $A_L$, $B_L$ having a magnitude of 1.5 provides decision signal curves (see FIG. 5C) that are a useful approximation of the decision signal curves of the curve.

One preferred embodiment for a combined limiting - average value processing subcircuit 60 for the apparatus 50 of FIG. 5A is illustrated in FIG. 6. The processing subcircuit 60 includes the resistor network $R_1$–$R_8$, with resistors $R_1$, $R_2$ defining the average value resistive network. Independent amplifiers 62A, 62B amplify signal voltages produced by two independent PIR sensor elements to generate the analog detection signals A, B. The amplifiers 62A, 62B illustrated in FIG. 6 are LM224 operational amplifiers. These amplifiers can provide an output swing from almost GND potential to a limited voltage that varies over temperature, by manufacturer and by batch code. Typically, the upper range will be $V_{supply}-0.9$ to $V_{supply}-1.3$ volts. Alternatively, 3260 operational amplifiers may be used.

For the embodiment illustrated in FIG. 6, a third LM224 operational amplifier 62C is used. The third amplifier 62C has an output of 1 and has the positive input thereof connected to +5V and the negative input thereof connected to GND. This configuration will saturate the output stage to the highest available drive voltage, typically about 3.9 V when running on 5 V. Since the third op-amp 62C is built on the same substrate as the other op-amps 62A, 62B, the output drive voltages for these op-amps may be assumed to be limited to about the same level as the output 1 from the third op-amp 62C, when used under the same output load conditions. Since the load conditions are not equal, i.e., node 64 is loaded with about 250 microamps while nodes 66, 68 are loaded with about 10 microamps, a compensating adjustment is made by means of the values of the resistors $R_3$ and $R_6$.

The limiting factor for the processing subcircuit 60 is selected to have a value of 1.6 based upon $(R_5+R_6)/R_5$, or (4.87K+2.94K)/4.87K). The resistive network of FIG. 6 limits the output of the amplifiers 62A, 62B to a value of 1.6 higher and/or lower than the predetermined thresholds of the LM339 comparators 70A, 70B that in combination define a comparator window. The limited analog detection signals $A_L$, $B_L$ outputted by the amplifiers 62A, 62B are summed by means of resistors $R_1$, $R_2$, respectively. The positive threshold, $V_H$, for the window comparator is node 72 and the negative threshold, $V_L$, for the window comparator is node 74. The open collector outputs of the LM339 comparators 70A, 70B are wire-orred at node 76.

A variety of modifications and variations of the present invention are possible in light of the above teachings. It is therefore to be understood that within the scope of the appended claims, the present invention may be practiced otherwise than as specifically described hereinabove.

What is claimed is:

1. An apparatus for combining analog detection signals generated by single sensor technology and mixed sensor technology intrusion detection systems, comprising:

means for generating first and second analog detection signals;

means for combining said first and second analog detection signals to provide an alarm decision signal having an amplitude;

comparator means having at least one predetermined threshold for comparing said amplitude of said alarm decision signal to said at least one predetermined threshold, said comparator means being operative in response to said amplitude exceeding said at least one predetermined threshold to generate an output signal for triggering a system alarm;

signal limiting means coupled to said first and second analog detection signal generating means for limiting amplitudes of said first and second analog detection signals to a predetermined limit value; and wherein said combining means provides said alarm decision signal having said amplitude equal to the amplitude of said first analog detection signal multiplied by the amplitude of said second analog detection signal.

2. The apparatus of claim 1 wherein said combining means comprises an analog multiplier.

3. The apparatus of claim 1 further comprising:

signal limiting means coupled to said first and second analog detection signal generating means for limiting amplitudes of said first and second analog detection signals to a predetermined limit value.

4. The apparatus of claim 1 wherein said comparator means comprises a first comparator having a high threshold and a second comparator having a low threshold; and further comprising OR means coupled to said first and second comparators for providing said output signal to trigger the system alarm whenever said amplitude of said alarm decision signal exceeds said high threshold and for providing said output signal to trigger the system alarm wherein said amplitude of said alarm decision signal exceeds said low threshold.

5. The apparatus of claim 1 wherein said combining means is a summing circuit for providing said alarm decision signal having said amplitude equal to the amplitude of said first analog detection signal added to the amplitude of said second analog detection signal, the sum thereof divided by two.

6. The apparatus of claim 5 wherein said summing circuit consists of first and second resistors coupled respectively to said first and second analog detection signal generating means and one another to provide said alarm decision signal having said amplitude equal to the amplitude of said first analog detection signal added to the amplitude of said second analog detection signal, the sum thereof divided by two.

7. The apparatus of claim 6 wherein said first and second resistors have equal values.

8. The apparatus of claim 6 further comprising:

signal limiting means coupled to said first and second analog detection signal generating means for limiting amplitudes of said first and second analog detection signals to a predetermined limit value.

9. The apparatus of claim 6 wherein said comparator means comprises a first comparator having a high threshold and a second comparator having a low threshold; and further comprising OR means coupled to said first and second comparators for providing said output signal to trigger the system alarm whenever said amplitude of said alarm decision signal exceeds said high threshold and for providing said output signal to trigger the system alarm wherein said amplitude of said alarm decision signal exceeds said low threshold.

* * * * *

UNITED STATES PATENT AND TRADEMARK OFFICE

CERTIFICATE OF CORRECTION

PATENT NO. : 5,017,906

DATED : May 21, 1991

INVENTOR(S) : Math M.J. Pantus

It is certified that error appears in the above-identified patent and that said Letters Patent is hereby corrected as shown below:

On the title page;

In the Abstract, line 4, "method have utility with" should read --method of the present invention have utility with--.

In the Abstract, line 14, "value equal to one-half" should read value equal to one half--.

Column 1, line 23-24, "various Phenomena" should read --various phenomena--.

Column 3, line 67, "Fig. 4A and 4A′ illustrates" should read --Fig. 4A and 4A′ illustrate--.

Column 6, line 17, "decision signal curves of the curve" should read --decision signal curves of the desired curve--.

Signed and Sealed this

Sixteenth Day of March, 1993

*Attest:*

STEPHEN G. KUNIN

*Attesting Officer*

*Acting Commissioner of Patents and Trademarks*